US009694231B1

(12) United States Patent
Schuetz

(10) Patent No.: US 9,694,231 B1
(45) Date of Patent: Jul. 4, 2017

(54) HAND WEIGHT DEVICE

(71) Applicant: Bob Schuetz, Beckley, WV (US)

(72) Inventor: Bob Schuetz, Beckley, WV (US)

( * ) Notice: Subject to any disclaimer, the term of this patent is extended or adjusted under 35 U.S.C. 154(b) by 0 days.

(21) Appl. No.: 15/138,649

(22) Filed: Apr. 26, 2016

(51) Int. Cl.
*A63B 21/00* (2006.01)
*A63B 21/075* (2006.01)
*A63B 21/072* (2006.01)

(52) U.S. Cl.
CPC ..... *A63B 21/075* (2013.01); *A63B 21/0726* (2013.01)

(58) Field of Classification Search
USPC ..... 482/106, 108, 109
See application file for complete search history.

(56) References Cited

U.S. PATENT DOCUMENTS 5,102,124 A * 4/1992 Diodati ..... A63B 21/0605 482/106
2014/0213422 A1* 7/2014 Marcus ..... A63B 21/075 482/108

* cited by examiner

*Primary Examiner* — Jerome W Donnelly

(57) ABSTRACT

A hand weight device for providing a physically stable but variable resistance to gravity includes a handle coupled to a housing. A first end cap is movably coupled to the housing to selectively provide access to an interior space through a first end of the housing. Weights are positionable in the interior space to increase gravitational resistance to lifting of the housing. Spacers are positionable in the interior space to occupy a remainder of the interior space after a selected number of weights is positioned in the interior space. Thus, the selected number of the weights positioned in the interior space is inhibited from moving freely within the interior space.

20 Claims, 4 Drawing Sheets

HAND WEIGHT DEVICE

BACKGROUND OF THE DISCLOSURE

Field of the Disclosure

The disclosure relates to weight devices and more particularly pertains to a new weight device for providing a physically stable but variable resistance to gravity.

SUMMARY OF THE DISCLOSURE

An embodiment of the disclosure meets the needs presented above by generally comprising a handle coupled to a housing. A first end cap is movably coupled to the housing to selectively provide access to an interior space through a first end of the housing. Weights are positionable in the interior space to increase gravitational resistance to lifting of the housing. Spacers are positionable in the interior space to occupy a remainder of the interior space after a selected number of weights is positioned in the interior space. Thus, the selected number of the weights positioned in the interior space is inhibited from moving freely within the interior space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
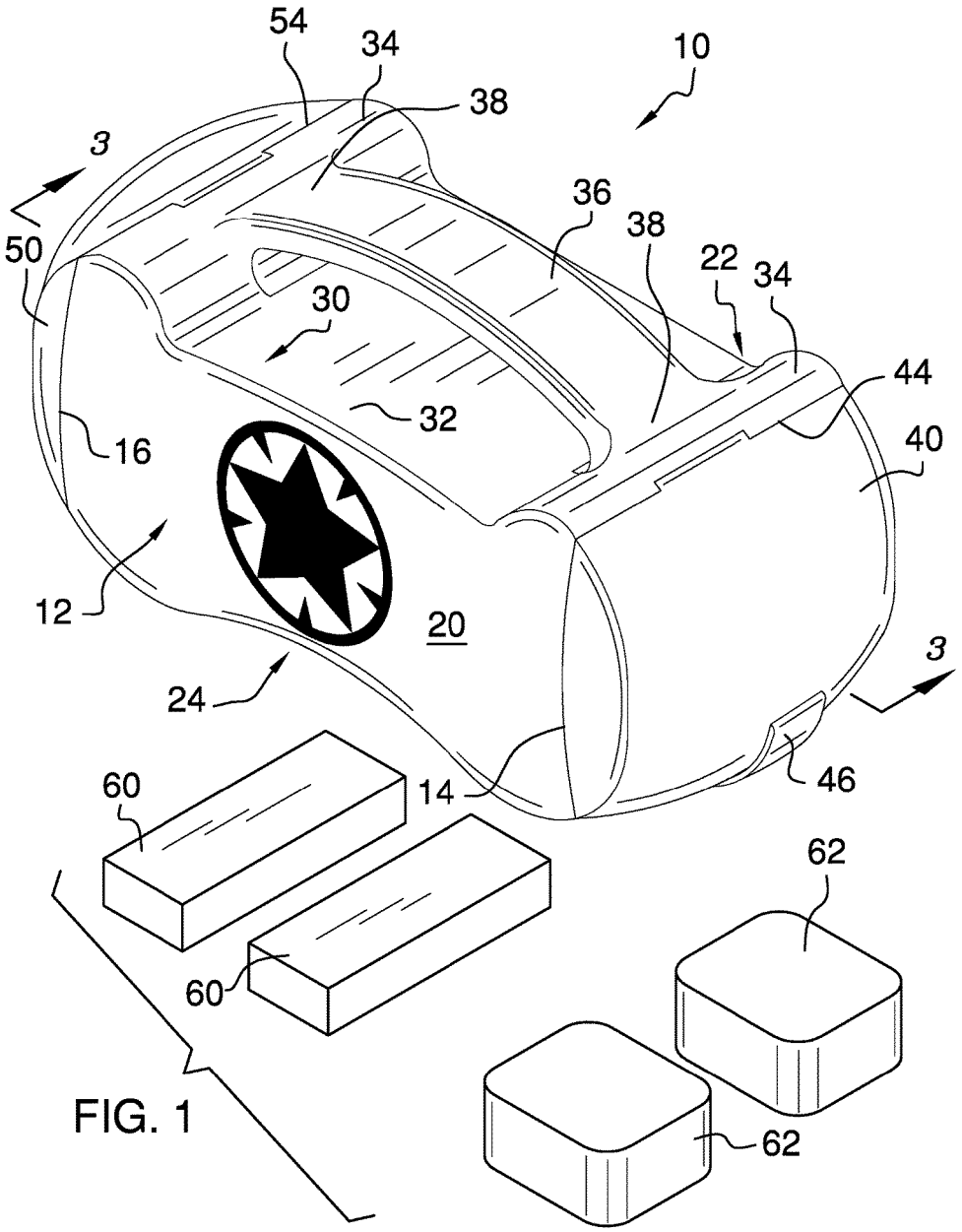
FIG. 1 is a top front side perspective view of a hand weight device according to an embodiment of the disclosure.
Figure 2:
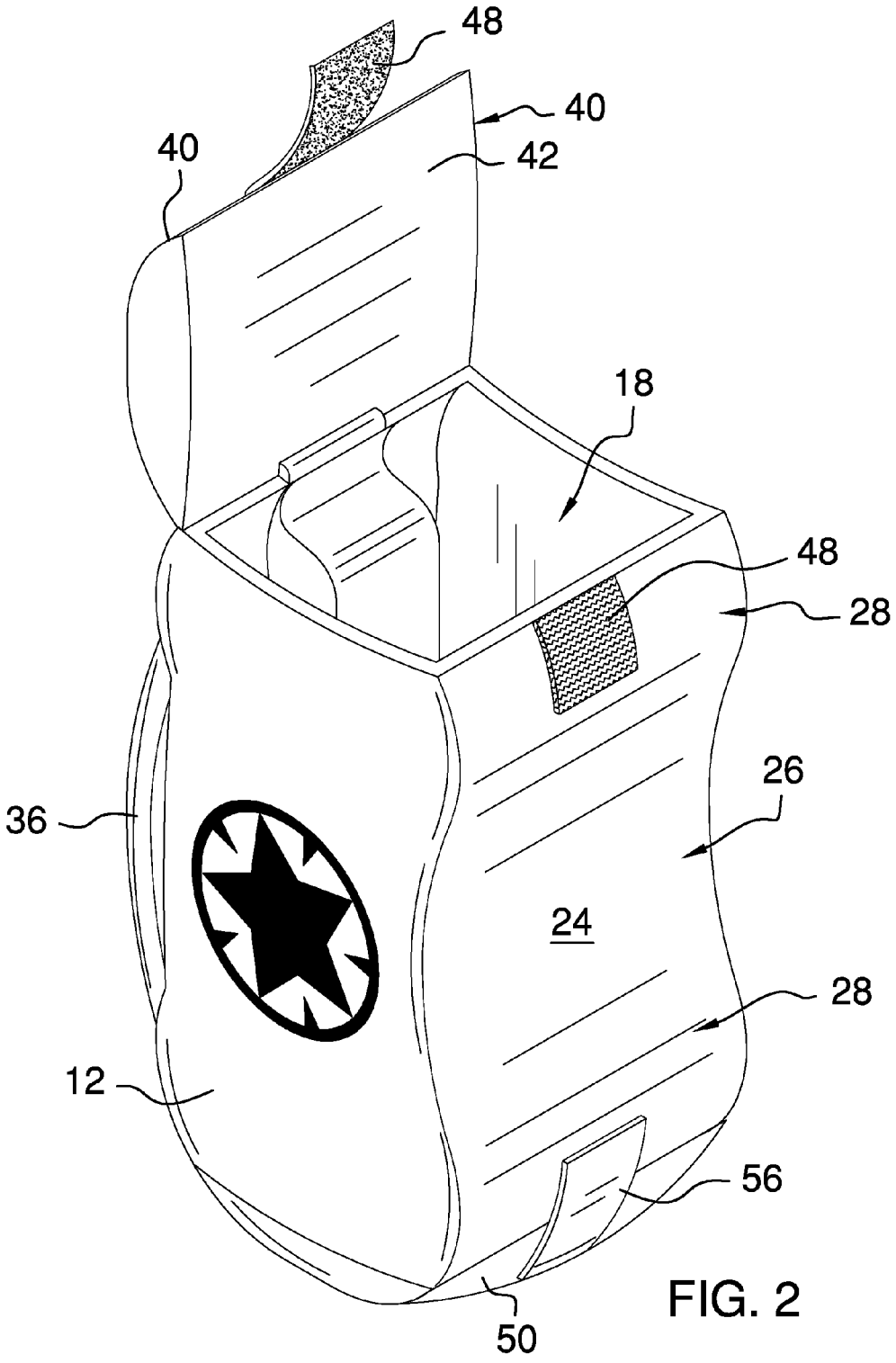
FIG. 2 is a bottom front side perspective view of an embodiment of the disclosure.
Figure 3:
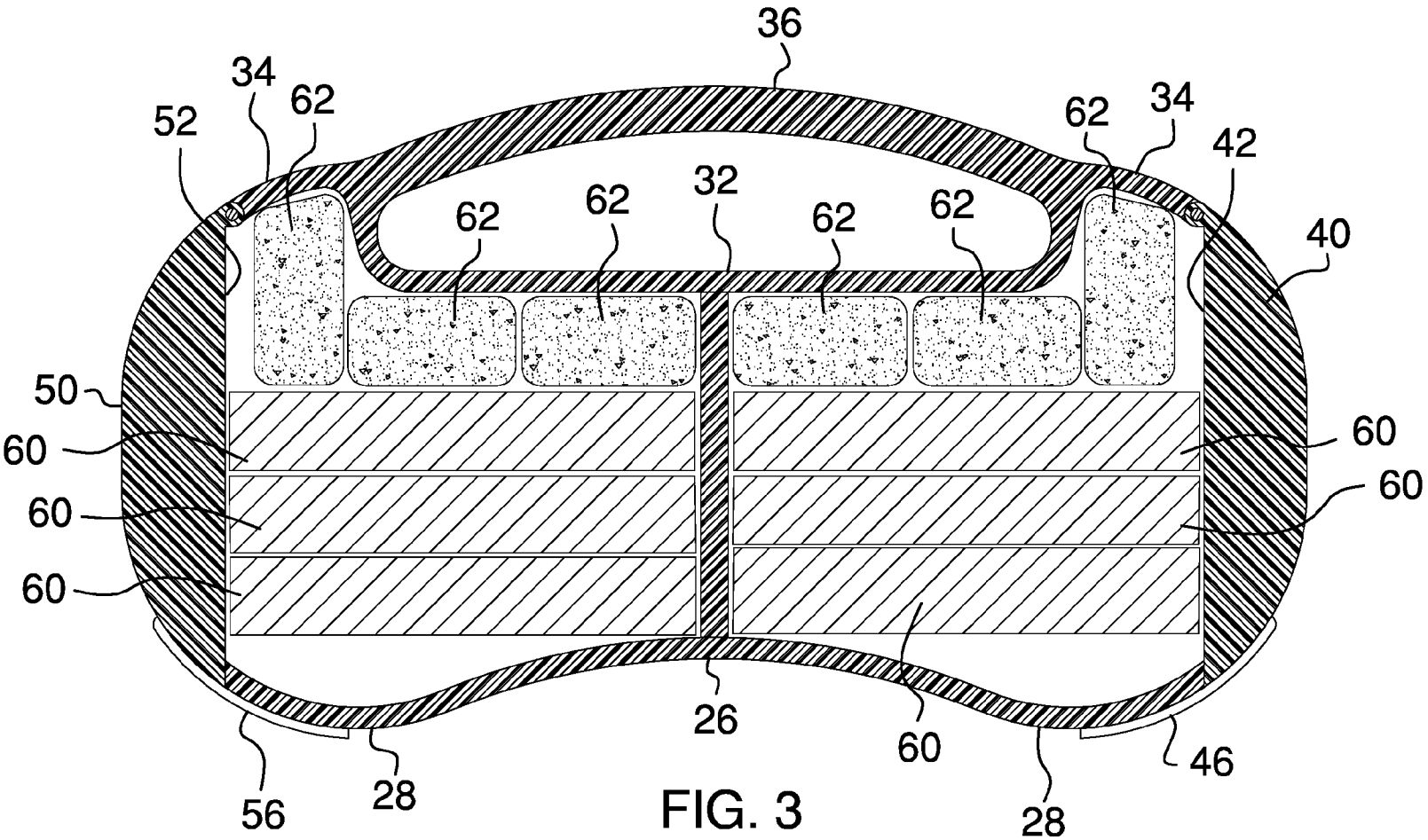
FIG. 3 is a cross-sectional view of an embodiment of the disclosure taken along line 3-3 of FIG. 1.
Figure 4:
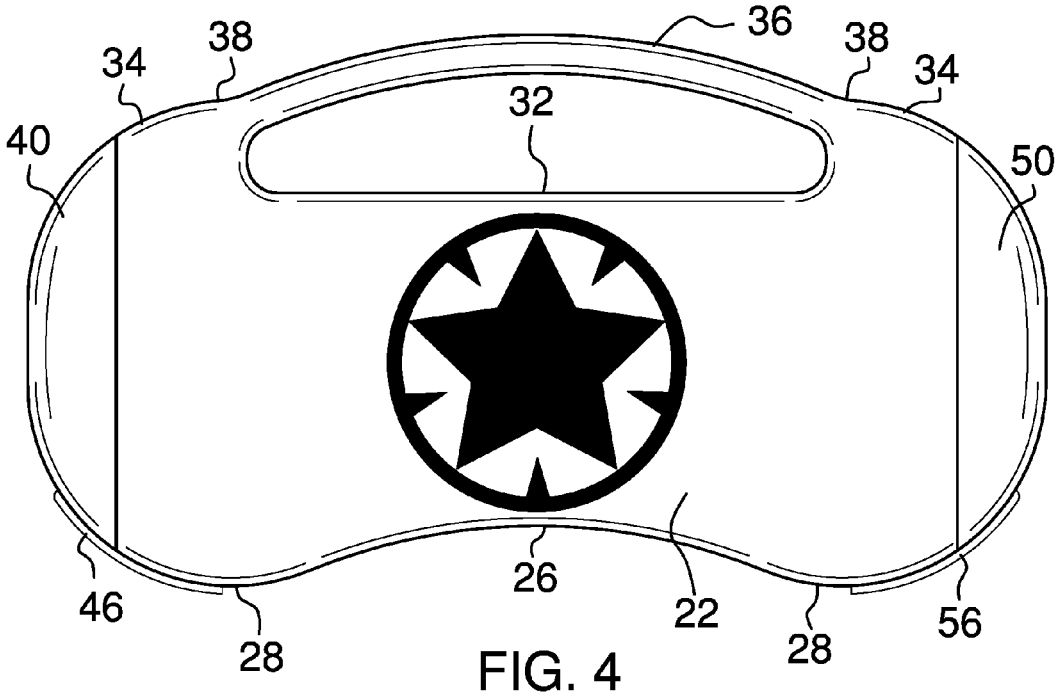
FIG. 4 is a front view of an embodiment of the disclosure.
Figure 5:
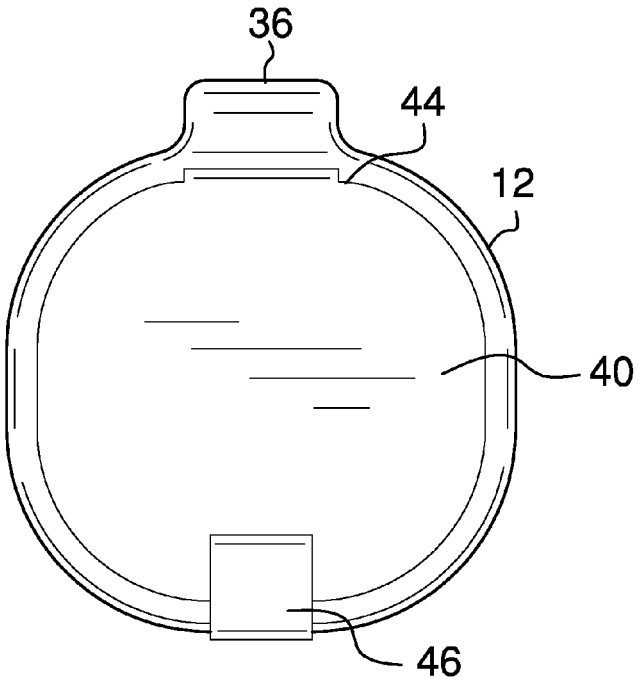
FIG. 5 is a side view of an embodiment of the disclosure.

With reference now to the drawings, and in particular to FIGS. 1 through 5 thereof, a new weight device embodying the principles and concepts of an embodiment of the disclosure and generally designated by the reference numeral 10 will be described.

As best illustrated in FIGS. 1 through 5, the hand weight device 10 generally comprises a housing 12 having a first end 14, a second end 16, and an interior space 18. The first end 14 of the housing 12 is open. The second end 16 of the housing 12 is open. The housing 12 has a front face 20 and a back face 22. The front face 20 is planar and the back face 22 is planar. The front face 20 is parallel to the back face 22.

The housing 12 has a bottom face 24. The bottom face 24 has a medial section 26 positioned between a pair of outer sections 28. Each outer section 28 is convexly arcuate. The medial section 26 is concavely arcuate. A top surface 30 of the housing 12 has a recessed portion 32 extending between raised outer portions 34.

A handle 36 is coupled to the housing 12 wherein the housing 12 is configured for being grasped and lifted by a user. The handle 36 is integrally coupled to the housing 12. Each of a pair of opposite ends 38 of the handle 36 is coupled to a respective one of the raised outer portions 34 wherein the handle 36 extends over the recessed medial portion 32 of the top surface 30. The handle 36 is arcuate extending between the opposite ends 38 of the handle 36. The handle 36 is convexly arcuate relative to the housing 12.

A first end cap 40 is movably coupled to the housing 12 such that the first end cap 40 is positionable to selectively provide access to the interior space 18 and to cover the first end 14 of the housing 12 such that the interior space 18 is enclosed at the first end 14. The first end cap 40 has a planar interior face 42 extending across the first end 14 when the first end cap 40 is positioned to cover the first end 14 of the housing 12. The first end cap 40 is pivotally coupled to the housing 12 by way of a hinge or the like. A top edge 44 of the first end cap 40 is pivotally coupled to the top surface 30 of the housing 12. A first closure 46 is coupled to the housing 12 and the first end cap 40 such that the first closure 46 is positionable to secure the first end cap 40 in a position covering the first end 14 of the housing 12. The first closure 46 may comprise complementary portions of hook and loop fastener 48.

A second end cap 50 is movably coupled to the housing 12 such that the second end cap 50 is positionable to selectively provide access to the interior space 18 and to cover the second end 16 of the housing 12 such that the interior space 18 is enclosed at the second end 16. The second end cap 50 is pivotally coupled to the housing 12. The second end cap 50 has a planar interior face 52 extending across the second end 16 when the second end cap 50 is positioned to cover the second end 16 of the housing 12. The second end cap 50 is pivotally coupled to the housing 12 by way of a hinge or the like. A top edge 54 of the second end cap 50 is pivotally coupled to the top surface 30 of the housing 12. The interior face 42 of the first end cap 40 is parallel to the interior face 52 of the second end cap 50 when the first end cap 40 covers the first end 14 of the housing 12 and the second end cap 50 covers the second end 16 of the housing 12. A second closure 56 is coupled to the housing 12 and the second end cap 50 such that the second closure 56 is positionable to secure the second end cap 50 in a position covering the second end 16 of the housing 12.

Each of a plurality of weights 60 is positionable in the interior space 18 such that the weights 60 are configured to increase gravitational resistance to lifting of the housing 12. Each weight 60 is an elongated parallelepiped. Each of a plurality of spacers 62 is positionable in the interior space 18 such that the spacers 62 are configured to occupy a remainder of the interior space 18 after a selected number of the weights 60 is positioned in the interior space 18. Thus, the selected number of the weights 60 positioned in the interior space 18 are inhibited from moving freely within the interior space 18. Each of the spacers 62 is constructed of a foam material such as styrofoam or the like. Each spacer 62 has a density less than the density of the weights 60 such that the spacers do not add appreciable heaviness to the housing 12.

A divider 68 is positioned in the interior space 18. The divider 68 is centrally positioned and parallel to the first end 14 of the housing 12 and the second end 16 of the housing 12 such that the interior space 18 is symmetrical about the divider 68. The first end cap 40 and second end cap 50 are designed to be symmetrical with the housing 12 to provide balance as the housing 12 is lifted. Each weight 60 may have a length substantially complementary to a distance between the divider 68 and the respective interior face 42,52 of the first end cap 40 and second end cap 50. Each weight may further be approximately one pound for ease of adjusting the total weight being lifted.

In use, a desired number of weights 62 are placed into each of the first end 14 and second end 16 of the housing 12. The remainder of the interior space 18 not occupied by the weights 60 is filled using the spacers 62 which secure the weights 60 into a static position relative to the housing 12. The first end cap 40 and second end cap 50 are each secured to the housing 12 enclosing the interior space 18. The housing 12 may then be grasped by the handle 36 and lifted repeatedly for exercise.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hand weight device comprising:

a housing, said housing having a first end, a second end, and an interior space, said first end of said housing being open;

a handle coupled to said housing wherein said housing is configured for being grasped and lifted by a user;

a first end cap, said first end cap being movably coupled to said housing such that said first end cap is positionable to selectively provide access to said interior space and to cover said first end of said housing such that said interior space is enclosed;

a plurality of weights, each of said weights being positionable in said interior space such that said weights are configured to increase gravitational resistance to lifting of said housing; and a plurality of spacers, said spacers being positionable in said interior space such that said spacers are configured to occupy a remainder of said interior space after a selected number of said weights is positioned in said interior space whereby said selected number of said weights positioned in said interior space is inhibited from moving freely within said interior space.

2. The device of claim 1, further comprising said housing having a front face and a back face, said front face being planar, said back face being planar, said front face being parallel to said back face.

3. The device of claim 2, further comprising said housing having a bottom face, said bottom face having a medial section positioned between a pair of outer sections, each said outer section being convexly arcuate, said medial section being concavely arcuate.

4. The device of claim 1, further comprising:

said second end of said housing being open; and a second end cap, said second end cap being movably coupled to said housing such that said second end cap is positionable to selectively provide access to said interior space and to cover said second end of said housing such that said interior space is enclosed.

5. The device of claim 1, further comprising said first end cap being pivotally coupled to said housing.

6. The device of claim 5, further comprising a top edge of said first end cap being pivotally coupled to a top surface of said housing.

7. The device of claim 4, further comprising said second end cap being pivotally coupled to said housing.

8. The device of claim 7, further comprising a top edge of said second end cap being pivotally coupled to a top surface of said housing.

9. The device of claim 1, further comprising said handle being integrally coupled to said housing.

10. The device of claim 9, further comprising:

a top surface of said housing having a recessed portion extending between raised outer portions; and each of a pair of opposite ends of said handle being coupled to a respective one of said raised outer portions wherein said handle extends over said recessed medial portion of said top surface.

11. The device of claim 10, further comprising said handle being arcuate extending between said opposite ends of said handle, said handle being convexly arcuate relative to said housing.

12. The device of claim 1, further comprising a first closure coupled to said housing and said first end cap such that said first closure is positionable to secure said first end cap in a position covering said first end of said housing.

13. The device of claim 12, further comprising a second closure coupled to said housing and said second end cap such that said second closure is positionable to secure said second end cap in a position covering said second end of said housing.

14. The device of claim 4, further comprising a divider positioned in said interior space, said divider being centrally positioned and parallel to said first end of said housing and said second end of said housing.

15. The device of claim 14, further comprising said interior space being symmetrical about said divider.

16. The device of claim 1, further comprising each weight being an elongated parallelepiped.

17. The device of claim 1, further comprising each of said spacers being constructed of a foam material.

18. The device of claim 1, further comprising said first end cap having a planar interior face extending across said first end when said first end cap is positioned to cover said first end of said housing.

19. The device of claim 18, further comprising:

said second end of said housing being open; and a second end cap, said second end cap being movably coupled to said housing such that said second end cap is positionable to selectively provide access to said interior space and to cover said second end of said housing such that said interior space is enclosed, said second end cap having a planar interior face extending across said second end when said second end cap is positioned to cover said second end of said housing, said interior face of said first end cap being parallel to said interior face of said second end cap when said first end cap covers said first end of said housing and said second end cap covers said second end of said housing.

20. A hand weight device comprising:

a housing, said housing having a first end, a second end, and an interior space, said first end of said housing being open, said second end of said housing being open, said housing having a front face and a back face, said front face being planar, said back face being planar, said front face being parallel to said back face, said housing having a bottom face, said bottom face having a medial section positioned between a pair of outer sections, each said outer section being convexly arcuate, said medial section being concavely arcuate, a top surface of said housing having a recessed portion extending between raised outer portions;

a handle coupled to said housing wherein said housing is configured for being grasped and lifted by a user, said handle being integrally coupled to said housing, each of a pair of opposite ends of said handle being coupled to a respective one of said raised outer portions wherein said handle extends over said recessed medial portion of said top surface, said handle being arcuate extending between said opposite ends of said handle, said handle being convexly arcuate relative to said housing;

a first end cap, said first end cap being movably coupled to said housing such that said first end cap is positionable to selectively provide access to said interior space and to cover said first end of said housing such that said interior space is enclosed, said first end cap having a planar interior face extending across said first end when said first end cap is positioned to cover said first end of said housing, said first end cap being pivotally coupled to said housing, a top edge of said first end cap being pivotally coupled to a top surface of said housing;

a first closure coupled to said housing and said first end cap such that said first closure is positionable to secure said first end cap in a position covering said first end of said housing;

a second end cap, said second end cap being movably coupled to said housing such that said second end cap is positionable to selectively provide access to said interior space and to cover said second end of said housing such that said interior space is enclosed, said second end cap being pivotally coupled to said housing, a top edge of said second end cap being pivotally coupled to a top surface of said housing, said interior face of said first end cap being parallel to said interior face of said second end cap when said first end cap covers said first end of said housing and said second end cap covers said second end of said housing;

a second closure coupled to said housing and said second end cap such that said second closure is positionable to secure said second end cap in a position covering said second end of said housing;

a plurality of weights, each of said weights being positionable in said interior space such that said weights are configured to increase gravitational resistance to lifting of said housing, each weight being an elongated parallelepiped;

a plurality of spacers, said spacers being positionable in said interior space such that said spacers are configured to occupy a remainder of said interior space after a selected number of said weights is positioned in said interior space whereby said selected number of said weights positioned in said interior space is inhibited from moving freely within said interior space, each of said spacers being constructed of a foam material; and a divider positioned in said interior space, said divider being centrally positioned and parallel to said first end of said housing and said second end of said housing, said interior space being symmetrical about said divider.

* * * * *